United States Patent [19]

Allington et al.

[11] Patent Number: 4,964,533

[45] Date of Patent: Oct. 23, 1990

[54] PUMPING SYSTEM

[75] Inventors: Robert W. Allington; Jon L. Curran; Jerold B. Schmidt, all of Lincoln, Nebr.

[73] Assignee: Isco, Inc., Lincoln, Nebr.

[21] Appl. No.: 713,328

[22] Filed: Mar. 18, 1985

[51] Int. Cl.[5] ..... B67D 5/08

[52] U.S. Cl. ..... 222/14; 222/63; 222/333; 417/17; 73/861.77; 73/864.18

[58] Field of Search ..... 222/63, 71, 333, 52, 222/14, 55, 642, 643; 73/861.77, 864.16, 864.18; 417/17

[56] References Cited

U.S. PATENT DOCUMENTS

| | | | |
|---|---|---|---|
| 3,743,140 | 7/1973 | Sauerbrey | 222/63 |
| 3,887,110 | 6/1975 | Porter | 222/63 X |
| 3,985,021 | 10/1976 | Achener et al. | 73/61.1 C |
| 4,008,003 | 2/1977 | Pinkerton | 417/250 |
| 4,159,785 | 7/1979 | Berry, Jr. | 222/63 |
| 4,475,666 | 10/1984 | Bilbrey et al. | 222/63 X |
| 4,531,839 | 7/1985 | Cunisse et al. | 222/63 X |
| 4,534,706 | 8/1985 | Palm et al. | 417/17 |

FOREIGN PATENT DOCUMENTS

| | | | |
|---|---|---|---|
| 2036167 | 6/1980 | United Kingdom | 222/63 |

OTHER PUBLICATIONS

IBM Technical Disclosure Bulletin, vol. 9, No. 8, Jan. 1967, p. 989.

*Primary Examiner*—Joseph J. Rolla
*Attorney, Agent, or Firm*—Vincent L. Carney

[57] ABSTRACT

To control with precision and repeatability the amount of fluid dispensed or aspirated by a pumping system, a volume disk rotates with the output shaft of a DC motor that drives a reciprocating dispensing pump. A sensor detects indicia on the disk and provides periodic signals spaced-apart in time by an amount: (1) an amount proportional to the volume of fluid pumped; (2) proportional to the angle between indicia; (3) less than one-third of the length of the total stroke of the piston as the piston moves linearly in its working portion of a cycle; (4) necessary for the piston to sweep out a volume of less than five milliliters. The speed of the pump is controlled by a second disk having equally spaced indicia that are sensed to provide signals proportional to the motor speed. During dispensing or aspirating large volumes, the motor speed is increased to a high speed, run at the high speed and then decreased before stopping and during dispensing smaller volumes, it is maintained at a constant lower speed.

6 Claims, 7 Drawing Sheets

PUMPING SYSTEM

BACKGROUND OF THE INVENTION

This invention relates to pumping systems and more particularly to pumping systems used as diluters or as dispensers.

In one class of pumping system used as a diluter or as a dispenser, pulses are generated as the pump motor rotates so that a number of electrical pulses are generated representing the number of rotations of the motor. The volume to be dispensed is represented by a number of pulses and compared with the pulses generated by the motor. The motor is stopped after a predetermined number of rotations or portions of rotations so that the programmed volume is dispensed or aspirated.

In this type of prior art dispenser or diluter, the pump is a peristaltic pump and the motor drives a rotor which compresses and releases tubing for the pumping action. The speed of the rotary motor is proportional to the flow rate and volume dispensed or aspirated in a fixed period of time.

The prior art dispensers or diluters utilizing peristaltic pumps have a disadvantage in that they are not precisely repeatable from dose to dose. The lack of repeatability is caused partly by the lack of reliability of the tubing used in peristaltic pumps since the amount of flexing of the tubing with the rollers driven by the motor may vary from time to time as the walls of the tubing are worked and changed.

Piston pumps are known to have high repeatability. However, the piston pumps: (1) have return strokes during which no pumping action occurs in a single chamber pump; (2) require a transmission mechanism to convert rotary to linear motion when the primary source of power is a rotary motor; and (3) may require complicated valving, particularly with multiple chamber pumps. The transmission and valves are sources of non-linearity.

Moreover, when low volumes of liquids are to be dispensed or aspirated by a piston pump, if the piston is changing from a retraction to an extension or vice versa, the dosage is affected greatly. If a very low volume is to be dispensed and the stroke is in the wrong direction, nothing may be dispensed, or if a larger volume is to be dispensed, the amount is difficult to control without an exact knowledge of the portion of the stroke of the piston.

It is known to control the speed of pumps by causing a disk to rotate with the pump motor and counting the pulses for comparison with a standard. For example, U.S. Pat. No. 3,985,021 to Achener et al, granted Oct. 12, 1976, discloses a piston pump to be used for high performance chromatography utilizing such a disk. The speed is controlled by means of the pulses which are unequally spaced on the disk to speed up the return cycle and reduce pulsations of liquid by so doing.

This type of prior art pump has the disadvantage of creating volume error when used as a dispenser and, while it controls the rate of pumping relatively well for chromatography, it does not accurately control the amount of dosage because emphasis is placed on a continuous stream of fluid at a continuous rate of flow rather than on a controlled volume. Thus, the indicia on the disk do not control the length of a stroke but instead the speed of movement of the piston so that indicia are present when, in fact, there is only a return stroke. In the return or chamber filling stroke, the indicia are fewer in number than during a pumping stroke to increase speed during the return stroke but some are sensed.

SUMMARY OF THE INVENTION

Accordingly, it is an object of the invention to provide a novel method and apparatus for dispensing fluids.

It is a further object of the invention to provide a novel method and apparatus for diluting fluids.

It is a still further object of the invention to provide a novel diluter and/or dispenser of fluids having high repeatability and precision.

It is a still further object of the invention to provide a novel pumping system in which the pump motor generates signals spaced in time and proportional to the volume being pumped, which pulses control the pumping.

It is a still further object of the invention to provide a pumping system which generates pulses proportional to the linear movement of a piston during only one portion of its stroke, which pulses are used to control the length of stroke of the piston.

It is a still further object of the invention to provide a pumping system having a rotary pump motor and a means for generating at least one signal for each increment of linear motion of the piston in a piston pump stroke, which increments are equal to no more than one-third of linear motion of the piston.

In accordance with the above and further objects of the invention, a pumping system to be used as a dispenser or diluter, includes a positive displacement pump, having a piston which reciprocates along a straight line within a cylinder. The motor is a rotary motor connected to the piston through a transmission. The motor carries on its shaft a disk which rotates with the motor and thus has a nonlinear relationship with the volume of fluid pumped. The disk has indicia on it which are sensed by an indicia sensor and spaced from each other a distance directly relatable to the volume displaced by the pump during a dispensing or aspiration operation. Thus, the indicia and indicia sensor together sense and convert the nonlinear relationship to a linear relationship with the volume of fluid pumped by the pump.

With this arrangement, a signal is generated for each of a plurality of equal increments of volume and equal increments of the piston's movement in the direction of expelling fluid during a dispensing operation or expelling and aspirating liquid during the dilution operation. Each of these increments is displaced during an increment of indicia, which in the preferred embodiment is the distance or angle between indicia.

To pump equal volumes of fluid for each increment of indicia on the disk, the ratio of each increment to the total cycle distance is equal to no more than: (1) one-third of the linear motion of the piston stroke while expelling fluid during the dispensing operation or piston stroke in either the expelling or aspirating motion during dilution or (2) one-third of the displacement volume; or (3) one-third multiplied by a factor, which factor is the cross-sectional area of a cylinder multiplied by the total length of the stroke of a piston in one direction during a pumping cycle. The stroke of the pump may be adjusted in the preferred embodiment from time to time as desired in a manner to be described hereinafter.

During pumping, the speed of the motor is controlled by a feedback loop. In some modes such as a pumping mode, the feedback signal is supplied from another disk having indicia upon it which are sensed at equal increments so that the number of sensed indicia per unit time is equal to the speed of the motor. The motor is controlled by feedback utilizing these pulses and in the dispensing mode is controlled by feedback from the volume disk so that for the dispensing of small amounts of fluid, the motor operates at a uniform slow speed while with larger volumes the motor is increased to a higher speed near the beginning of the dispensing operation to reduce the necessary time and slowed down near the end to reduce overshoot.

From the above description, it can be understood that the dispensing pumping system and/or dilution pumping system of this invention has several advantages such as: (1) it provides repeatable operation utilizing a piston; (2) it accurately dispenses or aspirates volumes of fluid with precision; and (3) it provides relatively economical operation.

SUMMARY OF THE DRAWINGS

The above-noted and other features of the invention will be better understood from the following detailed description when considered with reference to the accompanying drawings in which.

DETAILED DESCRIPTION

Figure 1:
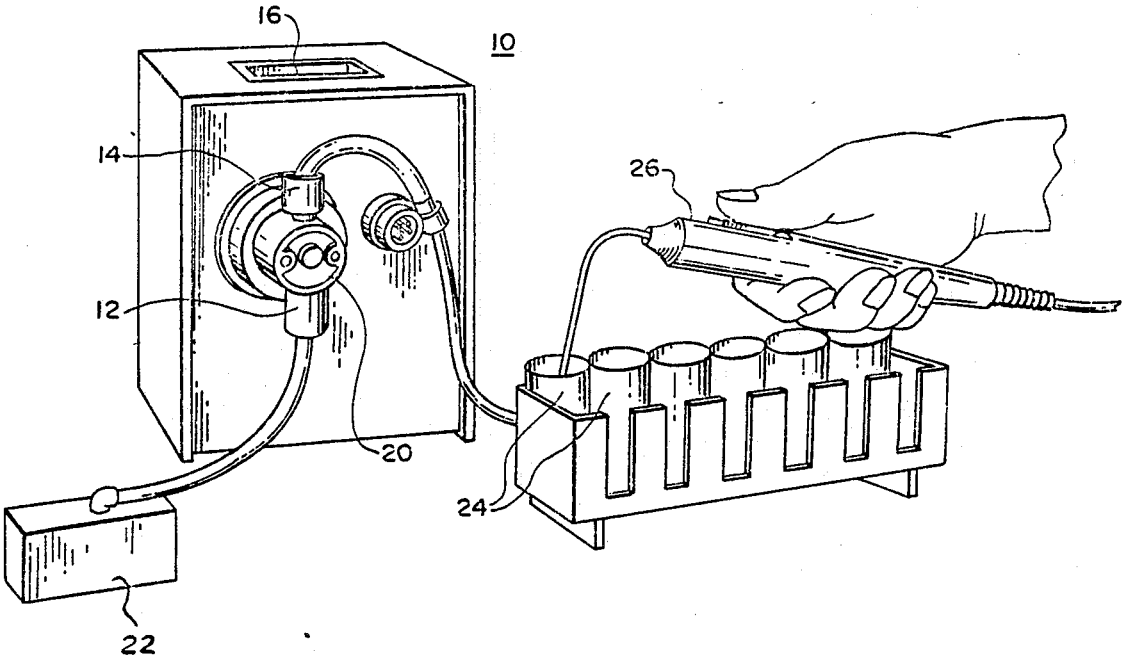
FIG. 1 is a perspective view of an embodiment of the invention.

In FIG. 1, there is shown a pumping system 10, having an inlet port 12, an outlet port 14, a control section 16 and a pump, a portion of the pump head being shown at 20. The pumping system 10 may be used as: (1) a pump to continuously pump fluid from a source such as that shown at 22 into another source; (2) a dispenser to dispense controlled volumes of fluid from a source such as 22 into containers or any other location such as shown at 24 under the control of an operator through a dispenser control handle 26; or (3) a diluter which may draw one or more volumes of a fluid from one or more of a plurality of containers such as those shown at 24 and dispense fluid into a container by drawing all of the fluids into the outlet port 14 and dispensing through the same port 14.

The pump is not in itself a part of the invention except as modified and combined with the other elements and is, in the preferred embodiment, a pump manufactured and sold by FMI Lab Pumps, Fluid Metering, Inc., 29 Orchard Street, Oyster Bay, NY 11771, and referred to as model RHB. This pump is described more fully in: (1) catalog RP401-84 obtainable from Fluid Metering, Inc. and (2) in U.S. Pat. Nos. 3,168,972; 3,257,953; and 4,008,003. The disclosure of the above catalog and patents is incorporated herein by reference to them.

The control system 16 includes a motor drive section, a sensor section, a motor drive control section, an input section and a signal processing section, all to be described hereinafter. While the pumping system 10 may operate as a pump and have its speed controlled by the circuitry to be described hereinafter, the inventive features apply primarily to the use of the pumping system as a dispenser and as a diluter rather than as a pump itself. The inventive features relate to the careful control of volume to be dispensed with precision and the ability to with precision, operate as a diluter.

Figure 2:
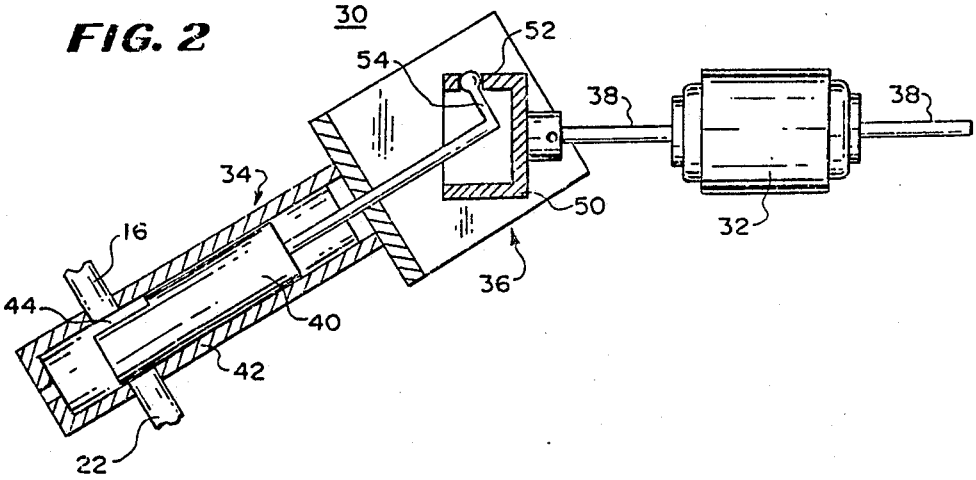
FIG. 2 is a schematic section view of a portion of FIG. 1.

In FIG. 2, there is shown schematically the pump 30 which is utilized in the pumping system 10 (FIG. 1) having a rotary power source 32, a pump cylinder assembly 34, a transmission section 36, and a motor shaft 38. The rotary power source 32 applies power to drive the pump cylinder assembly 34 through the transmission 36 which is attached to the pump cylinder assembly 34 and to the rotary power source 32. The rotary power source 32 is attached to the transmission 36 through its rotating output shaft 38, which shaft 38 extends through the opposite end of the rotary power source 32 for attachment to the sensing section to be described hereinafter.

The rotary power source 32 may be any type but in the preferred embodiment is a DC motor. It may be the same DC motor described in the aforesaid three patents and the catalog of FMI or may be any other DC motor. The piston pump 30, while having certain difficulties because of its reciprocating motion, has an advantage of repeatability over a peristaltic pump.

To provide reproducible action, the pump cylinder assembly 34 includes within it a reciprocating piston 40 which reciprocates back and forth within the cylinder 42 and has a slot 44 which provides for opening and closing the inlet and outlet ports 16 and 22. This action is described in the aforementioned patents and catalog of FMI.

To convert the rotary motion of the shaft 38 to corresponding reciprocating motion of the piston 40, the transmission 36 includes a collar 50, a universal ball joint 52, and an arm 54 as described in the aforementioned patents and catalog of FMI. The collar 50 is mounted to the shaft 38 for rotation therewith so as to carry the universal ball joint 52 and thus rotate the arm 54, which is attached at its distal end from the ball 52 to the piston 40.

With this arrangement, as described in the aforementioned patents and catalog, there is no pumping stroke when the piston 40 of the pump is aligned with the shaft 38 of the motor 32 but as the angle between the two increases the stroke increases. As may be observed, the precision of the pump may cause difficulties: (1) because the piston stroke is not linearly related to the angular motion of the motor shaft during its forward stroke; and (2) if a cycle incorporates a return stroke portion there is a portion of the motion of the piston that does not displace fluid so that in during the same period of time between different strokes different volumes are dispensed in accordance with the amount of time occupied by return stroke as compared to the forward stroke. A similar problem can occur during the dilution operation between the rearward stroke of the piston when it is drawing fluid in and the forward stroke when it is dispensing fluid.

These sources of inaccuracies are reduced by the control system to be described hereinafter which accurately controls the exact volumes of liquid which are displaced in accordance with input signals supplied to the control system input section by the operator of the pump in both the dispensing mode and the diluting motion of operation of the pump.

Figure 3:
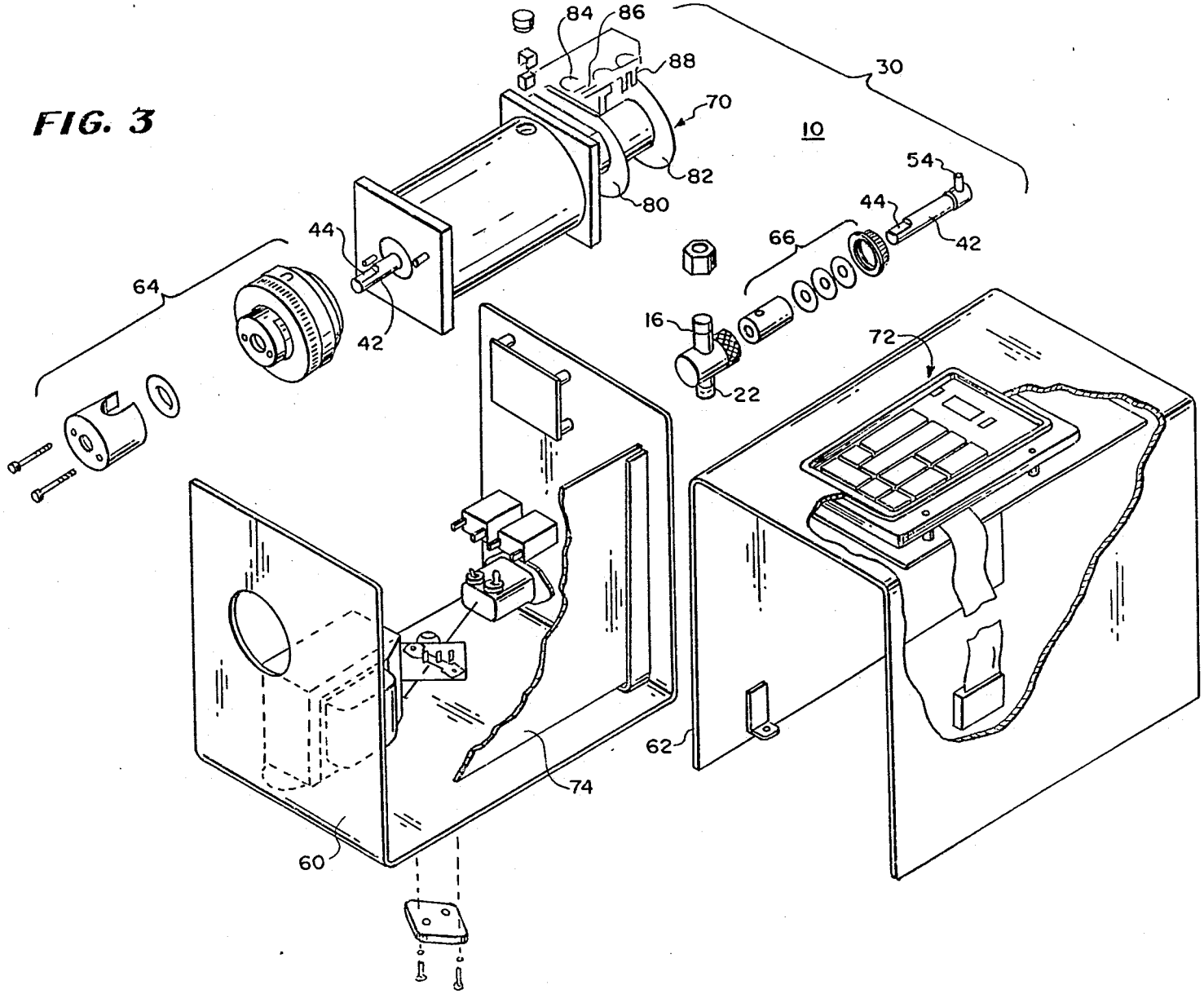
FIG. 3 is a simplified perspective partly broken away exploded view of an embodiment of the invention.

In FIG. 3, there is shown a fragmentary, partly broken away, exploded perspective view of the pumping system 10 having the pump 30 adapted to be inserted within a cabinet portion 60 and covered by a second cabinet portion 62 for attachment to the signal processing, motor drive and sensing sections. The pump motor 32 includes the pump head 64 and the washer, seals and openings 66 for operation substantially as shown in connection with FIG. 2.

The pump 30 is not by itself a feature of the invention, but the portions of the control system including the sensing section 70, the input section 72, and the motor drive, signal processing and motor drive control sections shown generally at 74 cooperate together to enable the accurate dispensing of volumes in a reproducible manner and thus the precise operation of the pump as a diluter. With this arrangement, an operator may indicate volumes in the keyboard 72 and control the pump to operate as a dispenser to dispense the accurate volumes or the pump may operate as a diluter to accurately withdraw and expell proportioned amounts of samples and dilutants.

As best shown in FIG. 3, the sensor section 70 includes: (1) a speed encoder disk 80; (2) a volume encoder disk 82; (3) first and second speed sensor assemblies 84 and 86; and (4) and a volume sensor assembly 88. The encoder disks 80 and 82 are mounted to the motor shaft 38 for rotation therewith to represent the position of the piston 40 (FIG. 2).

The speed control encoder disk 80, as it rotates, passes within each of the first and second speed sensor assemblies 84 and 86 and the volume encoder disk passes within the volume sensor assembly 88. These sensor assemblies are photo-electric and include, on one side, a light-emitting diode, and on the other side, a phototransistor. With this arrangement, the sensor assemblies are able to sense opaque and light transmitting portions of the encoder disks and thus generate signals indicating in coded form: (1) movement of the output shaft 38 (FIG. 2) of the pump motor 32; and (2) the position and movement of the piston 40 within the pump 30 (FIG. 2).

Figure 4:
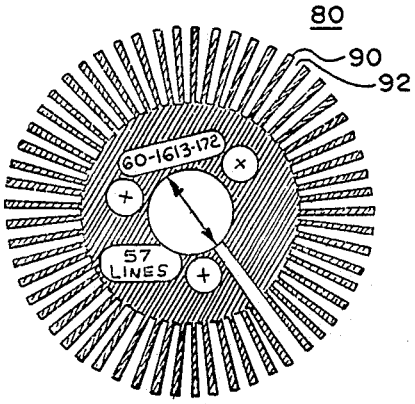
FIG. 4 is an elevational view of a portion of the embodiment of FIG. 1.

In FIG. 4, there is shown an elevational view of the speed control encoder disk 80, which is of plastic and has as its principal characteristic, circumferentially alternating opaque and light passing sections that are, in the preferred embodiment, radially extending lines, such as for example, the opaque line 90 and the adjacent light passing line 92.

The opaque lines extend radially and are circumferentially spaced equal distances from each other so that the light sensors receive periodic, regularly-spaced pulses of light. The pulses of light from the speed control encoder disk 80 are sensed and generate electrical pulses in a manner known in the art. The electrical pulses are differentiated to provide a pulse on the leading edge of the opaque section where the light is interrupted and thus provide a short pulse which is relatively small with respect to the space between pulses.

The sensors are spaced so that the detected edges of the pulses triggered by each are close in time to the edges of the pulses triggered by the other compared to the time between pulse edges from one of the sensors and thus the direction of rotation of the speed disk 80 is indicated by the relative placement in time of the pulse edges from the two sensors with respect to the time between pulse edges from one sensor. A pulse edge from a first sensor followed quickly by a pulse edge from the second sensor indicates clockwise rotation and the pulse edge from the second sensor followed quickly by a pulse edge from the first sensor indicates rotation in the counterclockwise direction.

In the preferred embodiment, the disk 80 has a central mounting hole of 0.578 inches and an opaque central section with radial lines extending outwardly to the outer diameter of 2.313 inches, there being 57 equally spaced opaque lines having a thickness the same as the alternate light passing sections.

Figure 5:
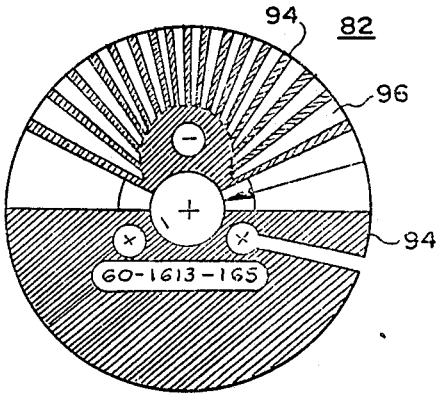
FIG. 5 is an elevational view of another portion of the embodiment of FIG. 1.

In FIG. 5, there is shown an elevational view of the volume encoder disk 82 which is of the same general size as the speed control encoder disk 80 (FIG. 4) but has a different arrangement for the opaque and light passing sections.

The volume encoder disk 82 includes alternate, radially-extending circumferentially-spaced opaque portions such as those shown at 94 and light transmitting portions such as those shown at 96. Similarly, the volume encoder disk sensors and motor are arranged so that: (1) the disk rotates with the motor shaft 38 (FIG. 2); (2) the opaque and light passing portions are detected by light emitting diode and phototransistor combinations; and (3) the leading edge of a light interruption is detected. However, the distance between signals generated represent the amount of volume pumped and the spacing between the light passing and opaque portions is arranged to provide such a representation.

The time between pulses represent one increment of volume swept from the cylinder and the number of pulses represents the total amount of volume swept from the cylinder. On the other hand, with a pump 30 (FIG. 2) included in the preferred embodiment of this invention, the time distance of the piston stroke is sinusoidal and not directly linearly related to the number of radians of rotation of the disk 80. In this case, where a cycle is considered a complete stroke of a piston reciprocating from one point to another and then back to the original point and that cycle corresponds to one revolution of the volume encoder disk 82, half of the disk is opaque and the other half has mixed opaque and light transmitting portions.

Half of the volume encoder disk 82 is unbroken opaque or light passing because at least half of a cycle is a return stroke in which no pumping occurs in a single chamber pump. In a double chamber pump, where one complete rotation of the disk corresponds to one cycle, the disk may consist entirely of indicia formed of circumferentially spaced opaque and light passing portions or two disks may be included one corresponding to each one-half cycle. Similarly, in other embodiments, the opaque and light passing portions can be reversed and light passing portions may generate the signal instead of opaque portions.

Although in the preferred embodiment, one revolution of the disk corresponds to one cycle of the pump, a portion of the disk may be used for a cycle depending on the transmission ratio between the rotating motor and the reciprocating pump. Thus, the transmission may be adjusted so that for each 180 degrees of rotation of the disk the pump completes a full cycle or for each 90 degrees of rotation of the disk the pump completes a full cycle or for any other fraction of the rotation of the disk a full cycle is completed.

In the preferred embodiment, the stroke is substantially sinusoidal because of the connection of the piston 40 (FIG. 2) to the universal ball joint 52 (FIG. 2) in the rotating collar 50 (FIG. 2) of the transmission 36. However, other transmissions may be used in other pumps and a different type of motion of the piston other than sinusoidal may occur with the rotating of the disk.

To accommodate the different nonlinear relationships between the piston and the rotating of the disk, the sensed portions, which in the preferred embodiment are the opaque portions 94, are spaced radially from each other a distance corresponding to the stroke of the piston during a pumping stroke of the pump. The motor and/or the transmission are controlled by the pulses generated and thus the precision of dispensing or of aspiration and expulsion of liquids depends upon the closeness of spacing with respect to the area swept out by the piston within the pump cylinder.

In the preferred embodiment of pump when in the dispense mode, the precision is a plus or minus five microliters when the pump is pumping from between 0.1 to 1 milliliter and a precision of plus or minus 0.5 percent of the dispensed volumes above 1 milliliter. In the dilution mode, the precision is 0.5 percent of the sample aspirated, 0.5 percent of diluent dispensed and 0.5 percent of the ratio of sample to diluent.

For satisfactory operation as a dispenser or as a diluter, the movement of the piston during the time between two successive signals, which movement pumps one increment of fluid and occurs during the time the volume-encoding disk rotates through the space between adjacent indications on it must be no greater than: (1) one-third of the stroke of the piston in one direction; and (2) no longer in one direction than one-third multiplied by the total length of stroke of the piston and by the cross-sectional area of the cylinder of the pump or of the face of the piston. Thus, the distance of a stroke of the piston between any two detected indications on the volume encoder disks during its rotation must be no greater than one-third of a product, that product being pi multiplied by the diameter of the face of the piston squared and by the length or, in other words, multiplied by the product of pi multiplied by the inter-diameter of the pump cylinder squared.

Figure 6:
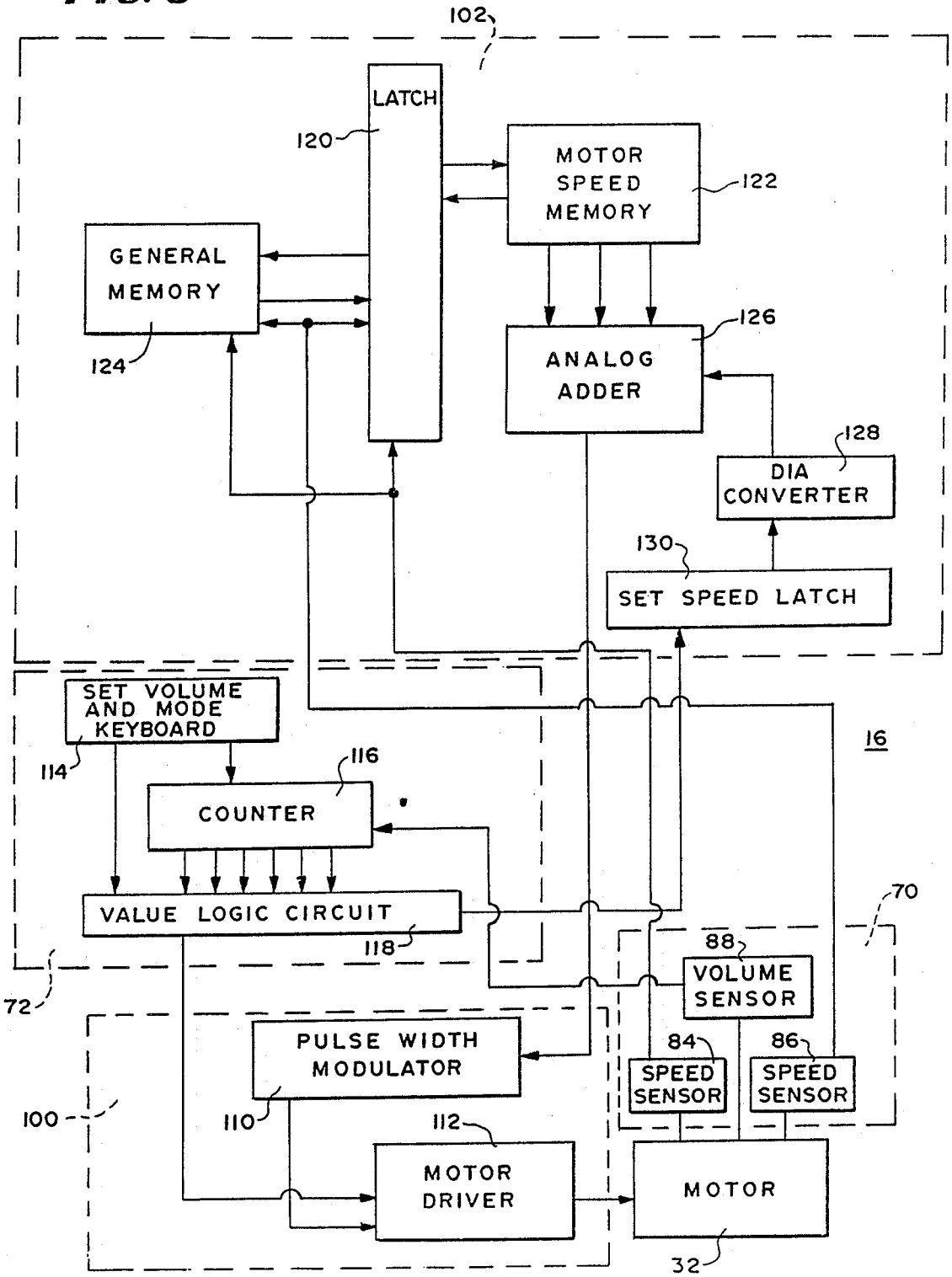
FIG. 6 is a block diagram of a portion of the embodiment of FIG. 1.

In FIG. 6, there is shown a block diagram of the control system 16 having a motor drive section 100, the sensor section 70, the input section 72 and a signal processing section 102. The motor drive section 100 drives the motor 32 to which it is connected and the motor 32 generates signals within the sensor section 70 indicating the volume, the speed and the direction, these signals are transmitted to the signal processing section 102.

To program the pump, the input section 72 is acted upon by the operator of the pump to program the desired volume and mode of operation into the pump. This information is encoded and applied to the signal processing section 102 and the motor drive section 100 to which the input section 72 is connected. The signal processing section 102 applies signals to the motor drive circuit 100 indicating the conditions of operation of the motor and the motor drive circuit 100 accordingly controls the motor 32 by applied potential to it to control the operation of the pump.

The sensor section 70 includes: (1) the first and second speed sensors 84 and 86; (2) the volume sensor 88; (3) the speed control encoder disk 80 (FIG. 3); and (4) the volume encoder disk 82 (FIG. 3). These disks cause the speed sensors 84 and 86 and the volume sensor 88 to generate a series of pulses.

The speed sensors 84 and 86 and the volume sensor 88 are driven by the shaft 38 (FIG. 2) of the motor 32 (FIG. 2) as described above, with the shaft representing the position of the rotor of the motor and thus the position of the piston. The readout from the disks thus provides information about the change in position of the piston; (2) the pumping rate; and (3) the volume pumped. The pulses from the speed sensors 84 and 86 are applied to the signal processing section 102 to provide a feedback signal for controlling the speed of the motor 32 through the motor drive section 100.

To drive the motor 32, the motor drive section 100 includes a pulse-width modulator 110 and a motor driver 112. The motor driver 112 receives a signal from the value logic circuit, and in response thereto, drives the motor in one direction or the other by reversing the polarity of the power applied to it in accordance with this signal. Power to drive the motor at a selected speed is applied from the pulse-width modulator 110.

The pulse-width modulator receives a signal from the signal processing section 102 which applies it to the motor driver 112 to provide duty control and the input section 72 selects an attenuation in the master driver 112 for the signal to be applied to the motor 32 to: (1) ramp up to a higher input to the motor 32 and thus higher motor speed for relatively large dispensing or aspirating volumes and down before stoping to avoid overshoot; and (2) to operate at a lower input to the motor and thus lower speed for small volumes. Its output is electrically connected to the motor drivers to modulate the potential of the motor drivers for the motor 32. The input section 72 also controls the polarity of the potential provided by the motor driver 112 to the motor 32.

The speed control may be of any type and the specific type of speed control of the motor is not a part of the invention. Speed control arrangements are known in the prior art and except insofar as this speed controller cooperates with the dispenser and diluter to dispense and aspirate precise volumes, it is not part of the invention.

To permit the operator to set the amount of fluid to be dispensed or the data for dilution, the input section 72 includes a set volume and mode keyboard 114, a counter 116 and a value logic circuit 118. The set volume and mode keyboard 114 includes a plurality of keys for setting the volume and selecting the mode such as whether it is to operate in the pump, dispenser or dilution mode. It includes other keys not a part of the invention.

In the embodiment of FIG. 6, one of the outputs of the set volume and mode keyboard 114 for programing volume is connected to the counter 116 and the other is connected to the value logic circuit to select the mode. The counter 116 receives a signal from the volume sensor 88 and applies output signals to the value logic circuit 118 which, in turn, sets the speed and determines the direction of rotation of the motor 32 and the direction of the piston 40 (FIG. 2) through the motor driver 112.

The signal processing section 102 includes a latch 120, a motor speed memory 122, a memory 124, an analog adder 126, a digital-to-analog converter 128 and a set speed latch 130. These units cooperate together to coordinate the operations of the input section 72, the motor drive section 100 and the sensing section 70, With this relationship, the set speed latch 130 receives the signal from the value logic circuit 118, determining if an increase in speed is necessary, and provides a signal to the digital to analog converter 128, which provides an analog signal to the analog adder 126 to control the speed of the motor 32. The latch 120 and the memory 124 receive signals from the speed sensors and provide a feedback signal to the motor speed memory 122 which supplies analog signals to the analog adder 126 indicating the speed that is required for the dispensing operation or for the dilution operation.

The analog adder 126 receives the inputs, adds them together and applies them to the pulse-width modulator 110 which applies a signal to the motor driver 112. The signals from the pulse-width modulator 110 are caused to have a duration corresponding to the time of dispensing and speed by the output from the adder 126. The pulse-width modulator selects certain attenuation for voltages within the motor drive 112 to provide ramping up and ramping down of speed in response to the value logic circuit 118.

Figure 7:
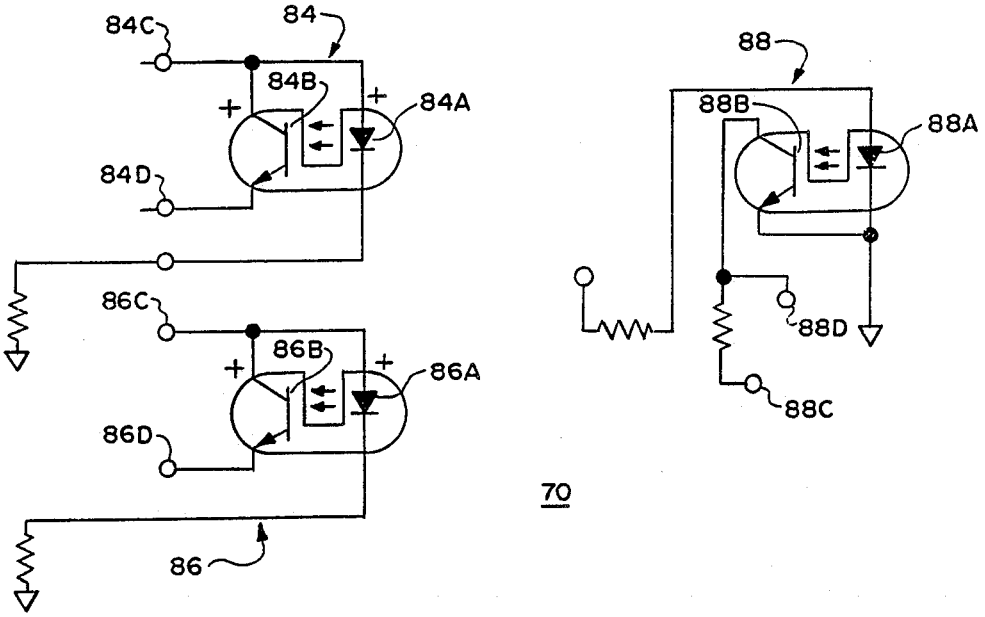
FIG. 7 is a schematic circuit diagram of a portion of FIG. 6.

In FIG. 7, there is shown a schematic circuit diagram of the sensor section 70 illustrating the first and second speed sensors 84 and 86 and the volume sensor 88. As illustrated by these drawings, each of the sensors includes a corresponding one of the light emitting diodes 84A, 86A and 88A and a corresponding one of the phototransistors 84B, 86B and 88B.

The speed control encoder disk 80 rotates between the phototransistors 84B and 86B and the light emitting diodes 84A and 86A. The light from the light emitting diodes reduces the resistance between the sources of five volts potential at 84C and 86C and the output terminals 84D and 86D respectively to provide an output signal at the terminals 84D and 86D. The interruption of this signal by an opaque portion of the disk, which increases resistance, is differentiated to provide the measured pulses.

Similarly, the volume encoder disk 82 (FIG. 3) passes between the light emitting diode 88A and the phototransistor 88B to reduce the resistance of the phototransistor during light passing portions and increase it during opaque portions to provide, at terminal 88D, a signal from the five volt source of potential at the terminal 88C.

The photodetector system and encoding disks are not per se novel except insofar as they cooperate with other elements of the invention. It is known by persons skilled in the art how to derive signals related to the rotation of a shaft. Any suitable technique may be used.

Figure 8:
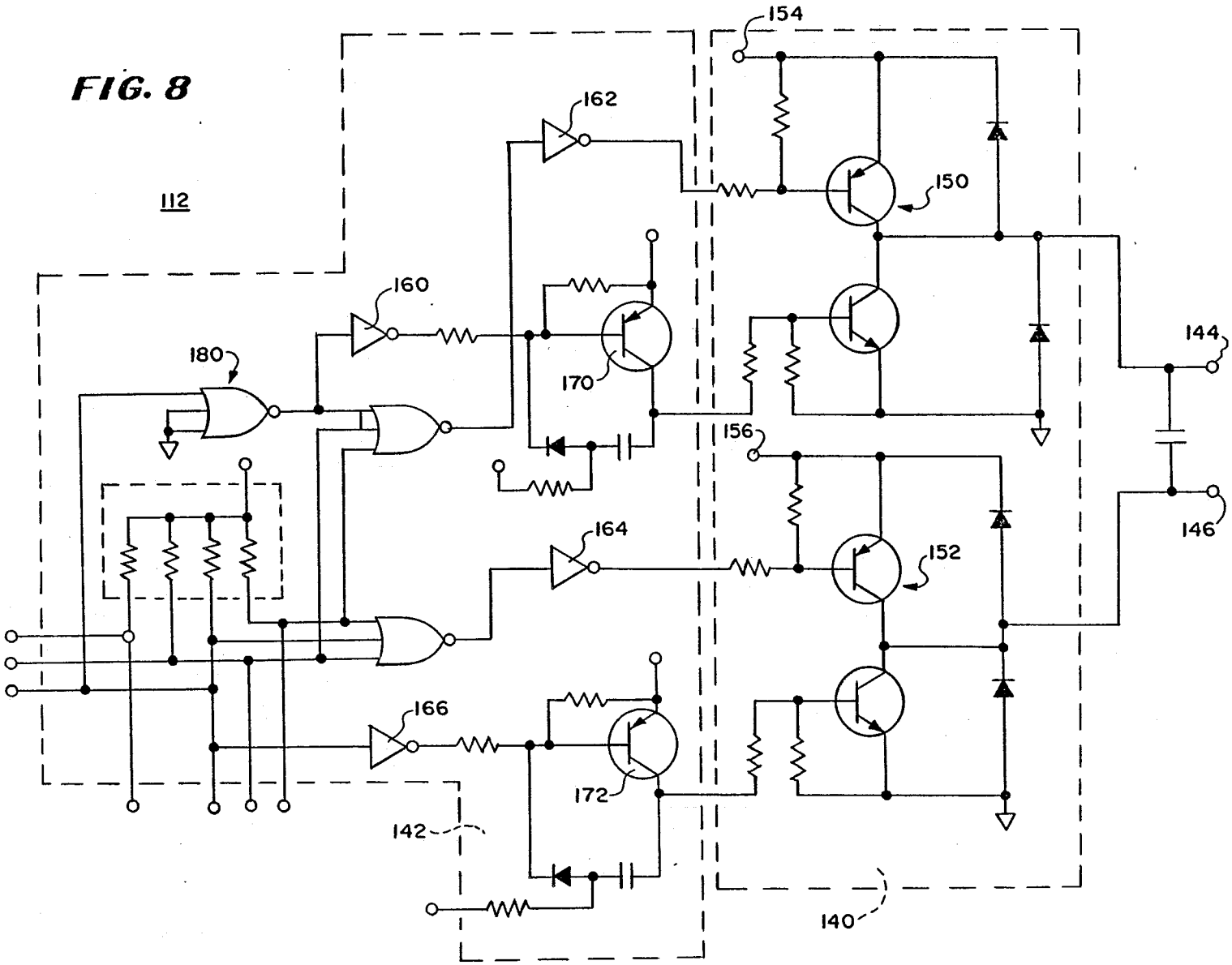
FIG. 8 is a schematic circuit diagram of another portion of FIG. 6.

In FIG. 8, there is shown a schematic circuit diagram of the motor driver 112 having a power section 140 and a selection section 142. The selection section 142 receives signals from the value logic circuit 118 (FIG. 6) and from the pulse-width modulator 110 (FIG. 6) and provides signals to the power section 140 to control the direction and amount of power applied to the motor by the power section 140. The power section 140 is electrically connected to the DC motor across terminals 144 and 146 with the direction of current flow to and from the terminals being controlled in accordance with signals from the selection circuit 142.

To control the application of power to the terminals 144 and 146, the power circuit includes first and second pairs of PNP transistors 150 and 152, each pair being electrically connected through the emitter of the first transistor and the collector of the second in series through positive 24 volt sources 154 and 156 so that, the selected one of the pairs of transistors 150 and 152 causes current to flow into a respective one of the terminals 144 and 146 and through the DC motor to the other terminal, with the return circuit being provided to ground by the unselected pair of transistors. Appropriate blocking diodes are used in a conventional manner to suppress potential. The transistors have their base controlled to modulate the amount of current flow and thus the speed of the motor.

To select the direction of current flow to the motor 32 (FIG. 6) and the amount of power applied to the motor, the selection circuit 142 includes inverters 160, 162, 164 and 166 which respectively control the transistors 150 and 152, with the inverter 160 being electically connected to the base of the PNP transistor 170 and the inverter 166 being electrically connected to the base of the PNP transistor 172, the aforesaid transistors being electrically connected to the collectors of the second of the transistor pairs 150 and 152 respectively and having connected to their emitters a source of a positive 24 volts to bias the base of the transistor pairs 150 and 152.

A selection circuit shown generally at 180 selects the inverters through a gating circuit to provide the speed and direction control through them in accordance with pulses received from the pulse-width modulator 110 (FIG. 6) and the value logic circuit 118 (FIG. 6). The pulse-width modulator 110 (FIG. 6) is the National Semiconductor regulating pulse-width modulator LM3524 connected to supply controlled pulses to the drivers. While this particular voltage source is used, others may be used in a manner known in the art.

Figure 9:
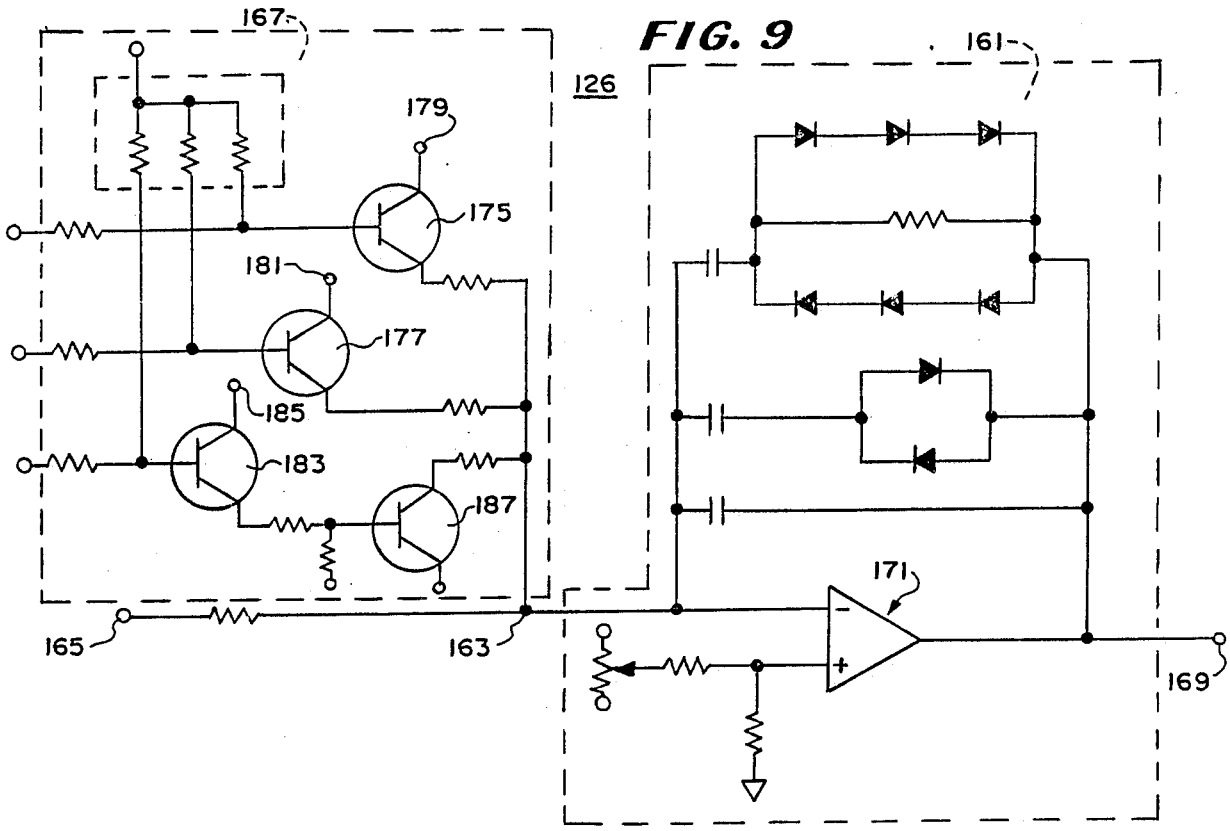
FIG. 9 is a schematic circuit diagram of still another portion of FIG. 6.

In FIG. 9, there is shown a schematic circuit diagram of the analog adder 126 (FIG. 6) having a signal setting network 161, an adding node 163, a speed feedback input terminal 165, and a speed feedback network 167. The signal processing circuit 161 is a conventional circuit for removing noise, and providing buffering for the speed signal from the adding node 162 to provide a signal on terminal 169 to the pulse-width modulator 110 (FIG. 6) for stable control of motor speed.

For this purpose, the signal processing network 161 includes an operational amplifier 171 having its inverting terminal electrically connected to the adding node 163. Feedback from its output to the inverting terminal includes capacitive filters, diodes and a resistor to provide stabililty. The terminal 169 is electrically connected to the amplifier 171.

Input terminal 165 is electrically connected to the output of the digital-to-analog converter 128 (FIG. 6) which generates an analog signal from the digital signal it receives from the set speed latch 130 (FIG. 6) which receives the input signal in digital form from the value logic circuit 118 (FIG. 6). The digital-to-analog converter 128 converts this signal to an analog signal, using conventional circuitry, for application to the adding node 163. Additionally, a signal is provided to the adding node 163 from three other inputs of the feedback circuit 167, which signals are generated in the speed feedback loop that includes the speed sensor 86 (FIG. 6) and the latch 120 and indicate the speed.

For this purpose, two of the three inputs contain PNP transistors 175 and 177, each having a positive five volts 179 or 181 connected to its emitter and having its base electrically connected to receive signals from the speed sensor 86 (FIG. 6) through the speed feedback loop and thus add a positive potential to the node 163 to create an increase in speed. The other input includes a similar PNP transistor 183 having a positive volt potential on its emitter and having its collector connected through a PNP inverter 187 to the adding node 163 to provide a negative potential for subtraction. The output from the transistors 175, 177 and 187 are applied from their collectors directly to the node 163 so that the transistors 175 and 177 increase the potential at the node 163 and the transistor 186 decreases it prior to the stopping of the motor to increase or reduce the speed of the motor 32 (FIG. 6) prior to a stop.

Figure 10:
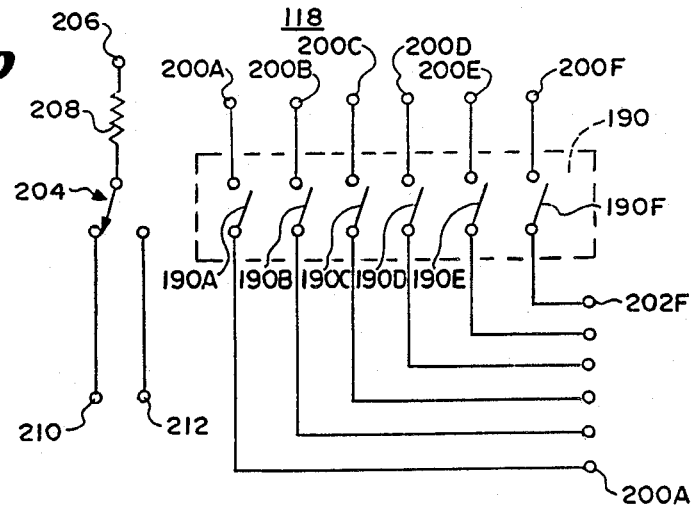
FIG. 10 is a schematic circuit diagram of still another portion of FIG. 6.

In FIG. 10, there is shown a schematic circuit diagram of an embodiment of value logic circuit 118 which is operated directly from a standard keyboard 114. The value logic circuit 118 includes a switching bank 190 containing a plurality of single-throw single-pole switches and a single-pole double-throw switch 204. The single-throw single-pole switches each have: (1) a different one of a plurality of contact electrically connected to a different one of the terminals 200A–200F and (2) a corresponding plurality of armatures 190A–190F which may be opened and closed against their corresponding contact and are electrically connected to a corresponding one of the terminals 202A–202F. The single-pole double-throw switch 204 has its armature electrically connected to a source of power 206 through a resistor 208 and its contacts electrically connected to different ones of the terminals 210 and 212.

With this arrangement, the switch 204 may be switched to one or the other of its fixed contacts to provide a different polarity signal to the motor driver 112 (FIG. 6) and thus control the direction of the motor and certain of the contacts 190 may be closed and others open with the outputs being electically connected for to the set speed latch 130 and others being adapted to latch other contacts to control the speed by applying a digital signal to the digital/analog converter 128 and thus to control the potential applied to the analog adder 126.

While a pumping system 10 has been described in hardware form, certain of the elements in the preferred embodiment are software which perform the function of hardware as an alternative. These elements are the latch 120, the motor speed memory 122, the memory 124, the counter 116, the value logic circuit 118 and the set speed latch 130, all of which are software equivalents of the hardware just described. The computing function is performed by an Intel 8749H HMOS single-component 8-bit microcomputer. The program for the computer is filed within the file wrapper of the patent and forms part of the disclosure herewith. The Intel 8749H HMOS single-component 8-bit microcomputer and the manner of using it is described in "MCS-48 Family of Single Chip Microcomputers User's Manual" published by and available from Intel Corporation, 3065 Bowers Avenue, Santa Clara, CA 95051, Copyright 1981, the disclosure of which is incorporated herein by this reference.

Figure 11:
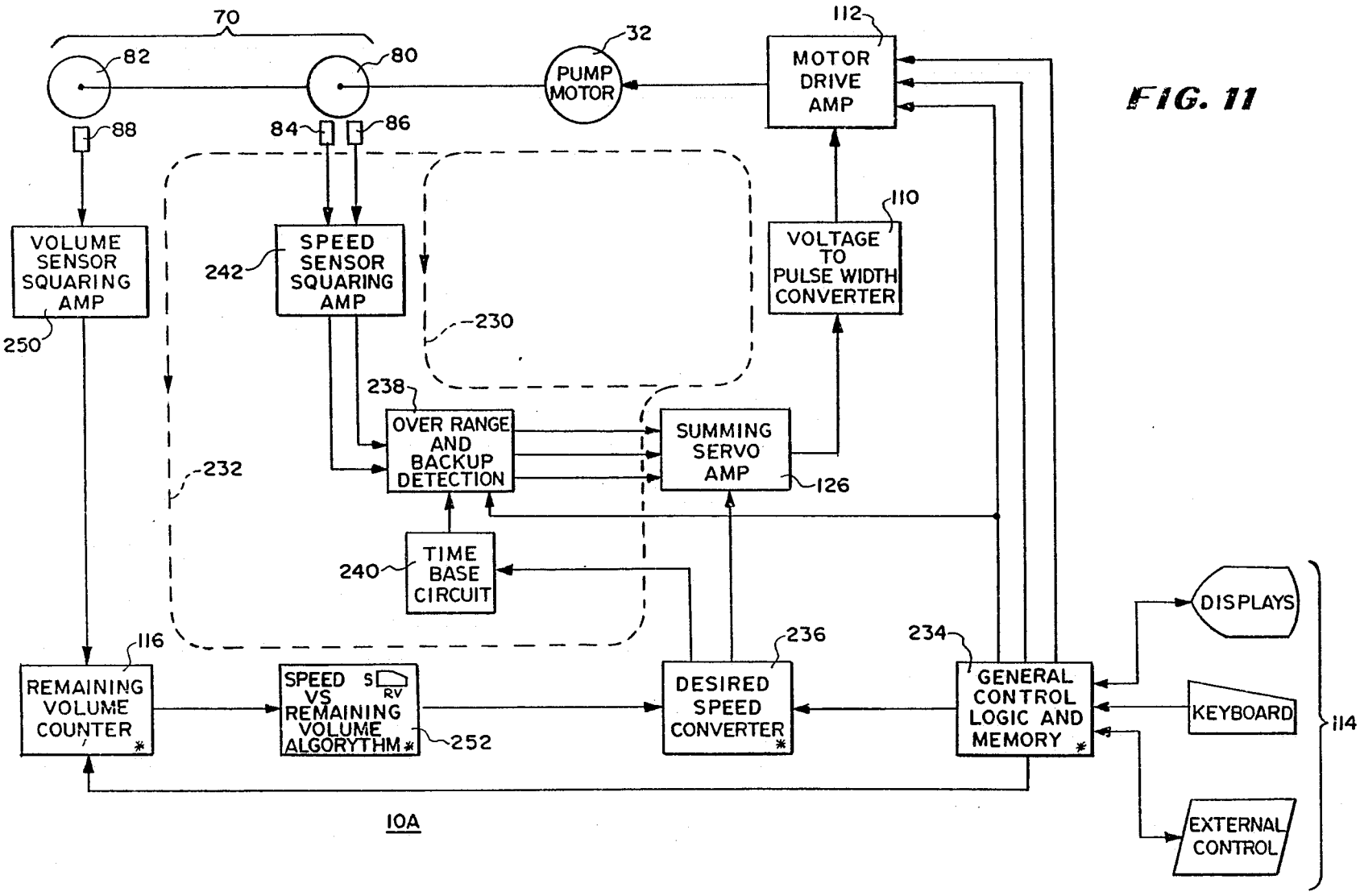
FIG. 11 is a schematic diagram illustrating another embodiment of the invention.

In FIG. 11, there is shown a schematic diagram of a pumping system 10A utilizing the attached program and the Intel 8749H HM OS single-component 8-bit microcomputer. In this figure, items which are the same as in the embodiment of the pumping system 10 are given the same reference numeral.

As shown in FIG. 11, the pumping system 10A is controlled, in part, by two feedback loops, which are: (1) a speed control loop 230, and (2) a volume control loop 232.

In cooperation with these loops: (1) the set volume and mode keyboard 114 receives from the operator and applies to the general control logic and memory 234 mode information, speed information for the speed mode and volume information; and (2) general control logic and memory 234 transmits the desired volume to the counter 116, the pump speed in the pump mode to a desired speed controller 236, the motor direction to an overrange and backup detector 238 and a speed servo override signal, motor enable signal and motor direction signal to the motor drive amplifier 112 to drive the pump motor 32.

To control the speed, the desired speed controller 236 transmits a signal to the summing servo amplifier indicating the desired speed within a range and a signal to a time base circuit 240. The time base circuit 240 provides a reference signal for flow rates outside a preset flow rate and the summing servo amplifier provides a reference for the desired flow rate to the speed control loop 230.

In this loop, a speed sensor squaring amplifier 242 receives signals from the speed detectors 84 and 86 and applies square pulses to the overrange and backup detector 238 for comparison. The overrange and backup detector 238 applies speed signals, backup signals and/or overrange signals to the summing servo amplifier 126 for feedback control of the pump motor 32 in the speed control loop 230.

To control the volume, a volume sensor squaring amplifier 250 applies the sensed volume signal to the input of the remaining volume counter 116 to count down the signal received from the general control logic and memory 234 indicating the desired volume. A speed vs. remaining volume algorithm indicated at 252, but controlled by the microprocessor in a manner known in the art and controlled by the attached program, applies signals to the desired speed converter 236 to control the speed and avoid overshooting as described above. This loop permits stopping of the motor 32 in the manner explained in connection with the hardware embodiment 10 under the control of the attached program.

As an alternate embodiment to the attached program using volume signals, it is possible to use only one disk, the speed disk, and a look-up table or other stored curve or analog function representing the volume at different points in a cycle as a substitute for signals generated at an increment of volume directly from the volume disk. For example, the pulses indicating equal increments of rotation of the motor may be counted from a cailbrated or indicated start position and the count used to generate a code for application to the digital to analog converter 128 and motor speed memory 122 (FIG. 6). Moreover, a second disk or the same disk could be used in which volume is indicated by a code on the disk to be sensed and used by the computer to generate the control signals instead of counting them.

In the operation of the pumping system 10 as a diluter or as a dispenser, the volume to be dispensed or aspirated is set in the keyboard, the mode of operation is selected and the pump started. As the motor of the pump rotates to drive the piston pump, increments of volume dispensed or aspirated are measured directly by a disk that rotates with the pump and has indicators on it spaced in relationship to the linear movement of the pump when operating in a cycle of its principal operation such as to force liquid out in the dispensing mode or to pull liquid in the aspirating mode. When the programmed volume is reached, the pump stops.

The desired volume to be dispensed or aspirated is entered into the keyboard 114 of the input section 72 of the control system 16. The mode is also entered into the keyboard and the start button is depressed either on the keyboard or from a handle having an equivalent bypass switch for the dilution mode. In the hardware embodiment having the input system 72 rather than the microcomputer control, the switches in the value logic circuit 118 are set to control the speed increments as the counter 116 is counted down from its volume which is set by the keyboard into the counter.

In a microprocessor version which is the preferred embodiment, the microprocessor stores the required volume in a software register and the register is decremented as the volume is counted by the disks. A decision step is undertaken during the decrementing of the software register for speed control.

If a large volume is set into this counter, a decision step indicates ramping up to a higher speed and when that speed is reached, the speed is maintained under the control of the microprocessor during decision steps in decrementing the counter. When the counter is decremented to a fixed point, a decision step begins to slow down the motor so that it stops at the correct value when the software register is fully decremented.

During the pumping action, the motor 32 (FIG. 2) rotates turning the shaft 38, which on one end turns the collar 50 within the transmission 36 to rotate the arm 54 of the piston 40 by the ball joint 52. As the piston arm rotates, the collar moves the piston 40 linearly within the cylinder to perform a pumping or a filling action.

As the motor turns, the volume disk 82 and the speed disk 80 both rotate and pulses are sensed by the sensing assemblies. The volume disk 82 has indications circumferentially spaced apart on the disk by angles directly proportional to the amount of fluid which is pumped or aspirated. Thus, on a return stroke, there are no indications for half of the disk where the disk rotates once for every revolution of the motor. The spacing between indications is equal to the linear stroke of the pump when it is dispensing during a dispensing or diluting cycle or in its aspirating action during an dilution cycle.

Each increment of the mechanism for generating pulses is equal to no more than one-third multiplied by a factor, which factor is the cross-sectional area of a cylinder multiplied by the total length of the stroke of a piston in one direction during a pumping cycle or one-third divided by a factor which factor is pi multiplied by the square of the inner diameter of the pump cylinder and by the length of the stroke.

To control the pumping rate, the speed encoded disk 84 has increments spaced apart equally in relation to the rotation of the pump shaft so that pulses are generated by the speed sensor 84 in direct proportion to the speed of the motor as the indicia pass the sensors.

In the hardware version of the pumping system, these pulses are applied to the latch 120 which is a hardware register that indicates the rate of generation of the pulses by registering them for clocked intervals and periodically resetting the register. These values are summed with the data recorded in the motor speed memory 122, and an error signal generated which results in signals which are applied to the analog adder 126 to increase or decrease the potential to be applied to the pulse width modulator 110 and thus control the motor drive 112. Thus, there is a feedback loop to control speed.

In the software version, the counter 116 receives the pulses and the count is converted to a speed by the speed vs. remaining volume algorithm 252. When the volume counter 116 indicates that the volume to be dispensed or aspirated is near the end, the spaced value in the desired speed converter is changed to a lower speed value, resulting in a reduced potential to the DC motor to slow the motor. When the volume is finally decremented, power is cut off to the motor and the dispensing operation is complete.

From the above description, it can be understood that the dispenser or the diluter of this invention has several advantages, such as: (1) it can dispense accurate amounts of liquid because of the careful volume counting system; and (2) it is repeatable in operation because of the use of a piston pump; and (3) it economically compensates for a lack of proportionality between the speed of the motor and the volume being dispensed.

Although a preferred embodiment of the invention has been described with some particularity, many modifications and variations are possible in the preferred embodiment without deviating from the invention. Therefore, it is to be understood that, within the scope of the appended claims, the invention may be practiced other than as specifically described.

What is claimed is:

1. Apparatus comprising:

a reciprocating positive displacement pumping system having a piston and a cylinder with said piston being capable of a predetermined full displacement stroke length;

a source of rotary power;

transmission means for actuating said positive displacement pumping system in response to said source of rotary power;

said transmission means including adjustable means for controlling the stroke length of said piston during a reciprocation between a said full displacement stroke length and a substantially shorter stroke length;

said apparatus including a movable element the motion of which has a nonlinear relationship with the volume of fluid pumped by said positive displacement pump;

circuit means for sensing and encoding the position of said element;

said circuit means including sensing means for sensing the position of said element, and encoding means for converting said nonlinear relationship to a linear relationship with volume of fluid pumped;

input means for setting a volume of fluid to be displaced by said pump;

control means for causing the volume of fluid displaced to equal the volume set into said input means;

said encoding means including means for generating at least one signal for each increment of linear motion of said piston in a piston stroke, which increment is equal to no more than one-third of the linear motion of said piston;

said means for generating at least one signal including means for generating at least one electrical signal for each portion of a cycle of the pump equal to more than one-third of the product of the linear motion of said piston in a piston stroke and the cross-sectional area of said cylinder divided by the total displacement volume of the pump;

said control means includes means for comparing said input signal with said signals generated for each increment and terminating the motion of said motor when said two are equal;

said element having a nonlinear relationship is the shaft of said source of rotary power;

said element including a disk mounted for rotation with said shaft and said encoding means including indicia upon said disk in a predetermined pattern and means for sensing said indicia as said disk rotates; and said encoding means including means for generating signals representing increments of volume pumped corresponding to said indicia.

2. Apparatus comprising:

a reciprocating positive displacement pumping system having a piston and a cylinder, with said piston being capable of a predetermined full displacement stroke length;

a source of rotary power;

transmission means for actuating said positive displacement pumping system in response to said source of rotary power;

said transmission means including adjustable means for controlling the stroke length of said piston during a reciprocation between a said full displacement stroke length and a substantially shorter stroke length;

said apparatus including a movable element the motion of which has a nonlinear relationship with the volume of fluid pumped by said positive displacement pump;

circuit means for sensing and encoding the position of said element;

said circuit means including sensing means for sensing the position of said element, and encoding means for converting said nonlinear relationship to a linear relationship with volume of fluid pumped;

input means for setting a volume of fluid to be displaced by said pump;

control means for causing the volume of fluid displaced to equal the volume set into said input means;

said encoding means including means for generating at least one signal for each increment of linear motion of said piston in a piston stroke, which increment is equal to no more than one-third of the linear motion of said piston;

said means for generating at least one signal including means for generating at least one electrical signal for each portion of a cycle of the pump equal to more than one-third of the product of the linear motion of said piston in a piston stroke and the cross-sectional area of said cylinder divided by the total displacement volume of the pump;

said control means including means for comparing said input signal with said signals generated for each increment and terminating the motion of said motor when said two are equal;

said element having a nonlinear relationship is the shaft of said source of rotary power;

said element including a disk mounted for rotation with said shaft and said encoding means including indicia upon said disk in a predetermined pattern and means for sensing said indicia as said disk rotates;

said encoding means including means for generating signals representing increments of volume pumped corresponding to said indicia;

means for controlling the speed of said pump;

said means for controlling the speed of said pump including: a second disk; said second disk having a plurality of indicia circumferentially equally spaced upon it; sensing means for sensing said equally spaced indicia on said second disk, whereby signals are generated relating to the position of said piston in said pump; and means for controlling the rate of generation of said signals by controlling said pump motor so that said pump speed operates in a first or second mode;

said first mode being a low dosage mode in which said motor operates at substantially a constant speed; and said second mode being a large dosage mode in which said motor increases, runs at a constant speed and then decreases to slow down.

3. Apparatus according to claim 2 in which said source of rotary power is a DC motor.

4. A method of controlling the fluid displacement of a positive displacement pump having a piston driven by a rotary motor through a displacement having a nonlinear relationship with the rotation of the motor and a variable displacement comprising the steps of:

generating signals as said motor rotates through angular segments of a revolution wherein the signals correspond to equal displacement of said positive displacement pump in a single direction;

recording a predetermined amount of displacement;

counting the number of angular segments in said displacement;

comparing the number of angular segments to reach said displaced value with the angular segments generated as said motor rotates;

stopping said motor when said angular segments are equal;

the step of generating signals including the step of generating a volume signal for each angular segment corresponding to no more than one-third of the linear motion of said piston; and controlling the speed of said pump by rotating a disk with the rotation of the motor;

sensing equally spaced indicia on said disk, whereby signals are generated relating to the position of said pump; and controlling the rate of generating of said signals by controlling said pump motor so that said pumping system operates in a first or second mode wherein said first mode is a low dosage mode in which said motor operates at substantially a constant speed; and said second mode is a large dosage mode in which said motor increases speed, runs at a constant speed and then decreases speed to slow down.

5. Apparatus comprising:

a positive displacement pumping system having a piston and a cylinder;

a source of rotary power;

transmission means for actuating said positive displacement pumping system in response to said source of rotary power;

said transmission means including a collar, a universal joint and an arm;

said collar being mounted to said source of rotary power for rotation therewith and to the universal joint whereby the universal joint is orbited by said collar in an orbital path at a selected angle to said piston;

said arm being mounted to the universal joint and to said piston, whereby said piston moves in a reciprocating motion with a stroke length dependent on the angle of said orbital path whereas the reciprocation motion of said piston has a substantially sinusoidal relationship with the rotation of said source of rotary power;

said apparatus including a first disk rotatable with said source of rotary power at a rate having a nonlinear relationship with the volume of fluid pumped by said positive displacement pump;

said first disk containing first indicia circumferentially spaced upon it;

first sensing means having means for sensing said first indicia;

encoding means electrically connected to said first sensing means for converting said nonlinear relationship to a linear relationship with a volume of fluid pumped by generating at least one first electrical signal for each increment of motion of said first disk and at least one second electrical signal responsive to at least one first electrical signal for each increment of motion of said piston;

input means for setting a volume of fluid to be displaced by said pump and generating a third signal representing said volume;

said means for generating at least one first electrical signal including means for generating at least one electrical signal for each portion of a cycle of the pump equal to more than one-third of the product of the motion of said piston in a piston forward stroke and the cross-sectional area of said cylinder divided by the total displacement volume of the pump;

control means for comparing said third signal with said second signal and terminating the motion of said motor when said two are equal; whereby the volume of fluid displaced equals the volume set into said input means;

a second disk;

said second disk having a plurality of second indicia circumferentially spaced upon it;

second sensing means for sensing said spaced second indicia on said second disk, whereby fourth signals are generated relating to the position of said piston in said pump;

means for controlling the rate of generation of said second signals by controlling said pump motor so that said pump speed operates in a first or second mode;

said first mode being a low dosage mode in which said motor operates at substantially a constant speed;

said second mode being a large dosage mode in which said motor spaced increases, runs at a constant speed and then decreases to slow down under the control of said fourth electrical signal.

6. A method of controlling the fluid displacement of a positive displacement pump having a piston driven by a rotary motor through a displacement having a substantially sinusoidal relationship with the rotation of the motor comprising the steps of:

generating first signals corresponding to the amount of rotation of the rotary motor, second signals corresponding to displacement of the piston and correlating the first and second signals to obtain third signals as said motor rotates through angular segments of a revolution wherein the third signals correspond to equal displacement of said positive displacement pump in a single direction;

recording a predetermined amount of displacement;

counting the number of angular segments in said displacement;

comparing the number of angular segments to reach said displaced value with the angular segments generated as said motor rotates;

stopping said motor when said angular segments are equal;

the step of generating first signals including the step of rotating a first disk and the step of generating second signals including the step of rotating a second disk and generating a volume signal for each angular segment corresponding to no more than one-third of the linear motion of said piston from said second disk;

controlling the speed of said pump by sensing equally spaced indicia on said first disk, whereby second signals are generated relating to the position of said pump;

controlling the rate of generating of said second signals by controlling said pump motor so that said pump speed operates in a first or second mode wherein said first mode is a low dosage mode in which said motor operates at substantially a constant speed; and said second mode is a large dosage mode in which said motor increases, runs at a constant speed and then decreases to slow down.

* * * * *